US005122065A

United States Patent [19]

Dudek et al.

[11] Patent Number: 5,122,065

[45] Date of Patent: Jun. 16, 1992

[54] INPUT OUTPUT CONNECTOR WITH COAXIAL SHIELDING AND STRAIN RELIEF

[75] Inventors: Thomas J. Dudek, Poughkeepsie; George M. Jordhamo, Wappingers Falls; Basil D. Washo, Poughkeepsie, all of N.Y.

[73] Assignee: International Business Machines Corp., Armonk, N.Y.

[21] Appl. No.: 743,633

[22] Filed: Aug. 12, 1991

[51] Int. Cl.[5] ..... H01R 13/648

[52] U.S. Cl. ..... 439/76; 439/108; 439/608; 439/610

[58] Field of Search ..... 439/76, 98, 610, 608, 439/607, 108

[56] References Cited

U.S. PATENT DOCUMENTS

| | | | |
|---|---|---|---|
| 4,602,832 | 7/1986 | Cunningham et al. | 439/108 |
| 4,706,381 | 11/1987 | Kato et al. | 439/108 |
| 4,731,031 | 3/1988 | Lemke | 439/76 |
| 4,753,005 | 6/1988 | Hasircoglu | 439/98 |
| 4,786,257 | 11/1988 | Tengler | 439/98 |
| 4,799,314 | 1/1989 | Lake | 29/846 |
| 4,806,105 | 2/1989 | Muzslay | 439/74 |
| 4,813,128 | 3/1989 | Massopust | 29/830 |
| 4,820,175 | 4/1989 | Hasegawa et al. | 439/98 |
| 4,824,383 | 4/1989 | Lemke | 439/608 |
| 4,902,234 | 2/1990 | Brodsky et al. | 439/67 |

*Primary Examiner*—Gary F. Paumen

*Attorney, Agent, or Firm*—Floyd A. Gonzalez; Laurence R. Letson

[57] ABSTRACT

A connector for terminating wires and cables is constructed of two mating thermoplastic members. One of the members carries a pattern of conductive material which forms edge contact pads, signal lines, ground lines and a ground buss interconnecting all ground lines. The other thermoplastic member is formed to include a series of ribs that parallel and contact the ground lines and ground buss. The surface of the thermoplastic member carrying the ribs and the ribs are plated with a copper layer and when assembled with the mating member forms grounded tunnel-like passages enclosing the signal lines and into which the signal conductors of the wires or cables extend to terminate on the signal lines.

17 Claims, 2 Drawing Sheets

INPUT OUTPUT CONNECTOR WITH COAXIAL SHIELDING AND STRAIN RELIEF

TECHNICAL FIELD OF THE INVENTION

This invention relates to conductor and cable connectors and more particularly to the type of connector which is used to connect signal lines to a mating connector and at the same time shield the signal lines from cross talk and interference.

BACKGROUND OF THE INVENTION

The connection of wires, coaxial cable and flat or ribbon cables to other connectors has been done by trapping or sandwiching a printed circuit board within a housing. The printed circuit board carries the edge contacts and attaching pads for terminating the conductors and shielding wires, if any. Of necessity, the printed circuit board must be thin and, therefore, fragile and/or unstable.

The use of a circuit board also creates manufacturing problems due t the difficulty in maintaining the required flatness of the connector assembly. The circuit board for this connector is so small size that signal/ground line symmetry is difficult to achieve, which leads to irregular signal delay for high speed signals through the connector. Further the use of the printed circuit board approach to connector design does not lend itself to coaxial grounding or shielding of the signal lines within the connector housing.

The circuit board connector relies upon a hot-melt adhesive to form a strain relief to help protect the connections between the contact regions on the circuit board and the conductors or wires entering the connector.

U.S. Pat. No. 4,799,314, issued to Ralph Lake, illustrates a scheme for grounding a printed circuit board, where a ground plane on one surface of the circuit board is forced against the support structure and the force is continually applied by means of a screw through the board and threaded into the support There is no disclosure of a connector for connecting another connector to a plurality of wires or a cable, and further the disclosure does not address coaxial shielding.

U.S. Pat. No. 4,806,105, to Steven Z. Muzslay, relates to a connector for interconnecting terminal pins on circuit boards that are stacked in a fixed spatial relation. The interconnecting is accomplished by a shunting bar carried by an insulated housing. The shunting bar has a tuning fork contact that spreads to engage a terminal pin on the printed circuit board. This patent does not address cable connectors and edge contact pads, but rather terminal pins.

Another inter-board connector is disclosed in U.S. Pat. No. 4,813,128, issued to Dan Massopust. This inter-board connector is a block of insulated material with holes formed there through. The holes are then through-hole-plated and the plated holes then forced over terminal pins on the printed circuit boards, thereby forming conductive interconnections between adjacent printed circuit boards. This device addresses the needs to interconnect adjacent printed circuit boards; but not cables or wires. It further does not address the need or desirability to coaxially shield the lines or connections.

A technique for creating a face-to-face engagement of two conductors and maintaining a force to insure continuity between the conductors is taught in U.S. Pat. No. 4,902,234, issued to Brodsky et al. The force to engage the sets of conductors in face-to-face engagement is provided by a resiliently deformable material which when compressed will continue to attempt to restore to the original shape and size and thereby force one set of conductors against the other. This tends to assure continuity between the conductors but does not address the need to connect cables or wires to a mating connector and to provide coaxial shielding for the signals lines and signals passing through the connector.

SUMMARY OF THE INVENTION

It is an object of the invention to provide coaxial shielding of the signal lines from the edge contact pad to the point where the wire or conductor is attached to the signal line.

It is another object of the invention to eliminate the need for additional assembly operations and materials to provide strain relief for the wires or conductors connected to the ground and signal conductors of the connector.

It is a further object of the invention to accommodate symmetrical signal and ground line layout in the confined space available within the connector.

It is an additional object of the invention to reduce the delay of high speed signals through the connector, by symmetry of the ground lines and the signal lines.

These and other objects of the invention are achieved by the forming of two shells which are configured to mate with each other. The shells are preferably injection molded of material that is highly stable. A first shell is coated or plated with various materials in succeeding steps to form signal edge contact pads, ground edge contact pads, signal lines, ground lines and a ground buss. The materials or metallurgy for these conductive elements may vary as necessary. The interior of the other of the shells has a number of ribs that project from the surface and lie parallel to the ground lines formed on the other shell when the shells are mated. The interior surface of the other shell is plated or coated with a conductive coating, including all surfaces of the ribs.

When the two shells are assembled, the exposed edge of the ribs are forced into abutting contact with the ground lines and the ground buss to create a grounded shield that substantially surrounds the signal lines of the other shell member.

The shells are formed with complimenting and mating walls or ribs that, when assembled, form a serpentine path through which the conductors, wires or cable must pass to enter the connector to be connected to the signal lines or the ground buss. This forms a strain relief for the wires or cables to relieve the forces at the attachment points.

BEST MODE FOR CARRYING OUT THE INVENTION

For a better understanding of the invention together with other objects, advantages and capabilities of the invention, reference is made to the aforementioned drawings and to the following detailed description of the best mode for carrying out the invention.

Figure 1:
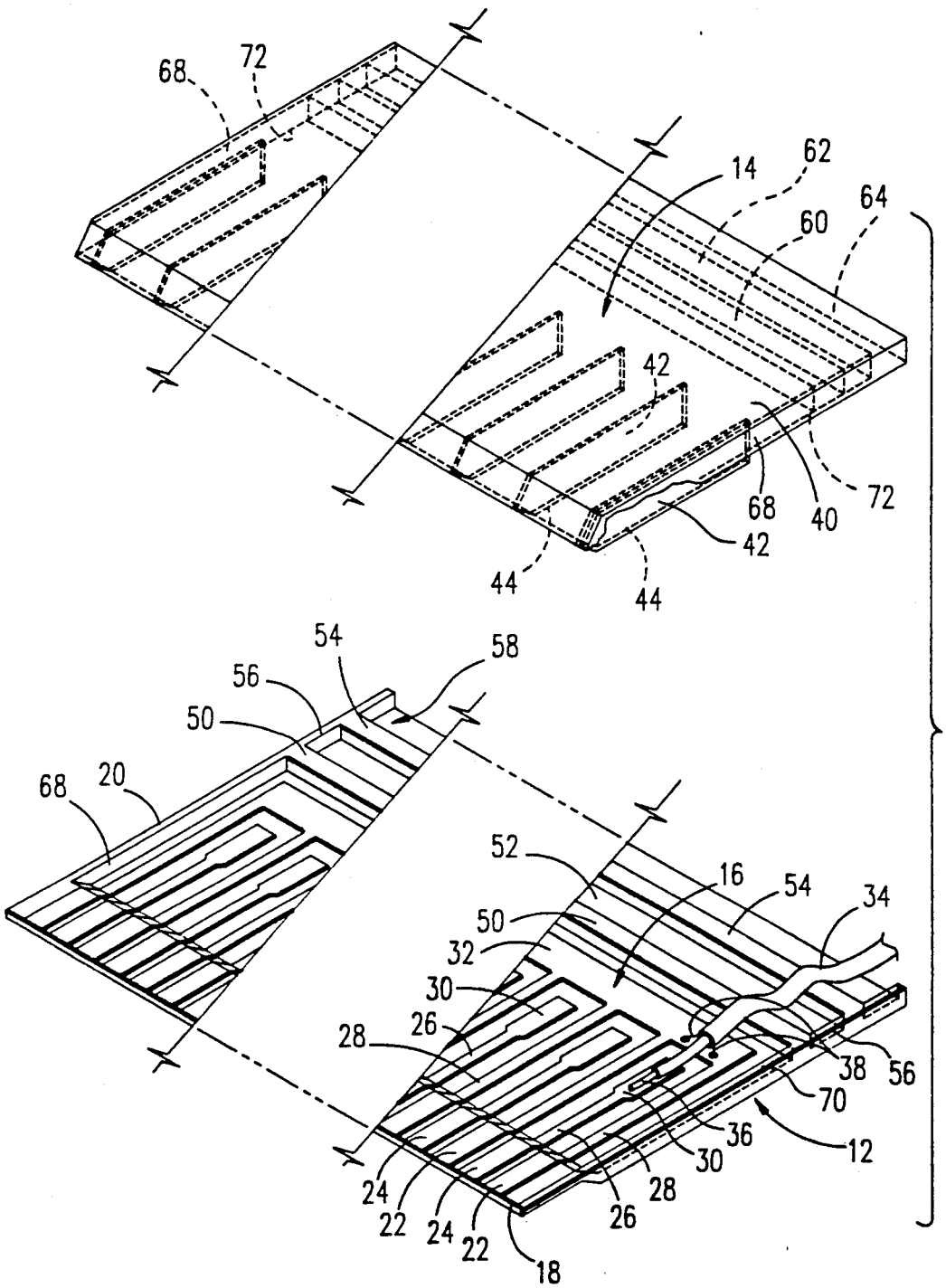
FIG. 1 is an exploded perspective view of the connector with the circuitry and the interior structure of the connector shown.

In FIG. 1, there is shown the connector 10 with the base shell 12 separated from the cover shell 14 for clarity. First, addressing the base shell or base 12, there is a cavity 16 or recessed region formed therein to accommodate the metallurgy and attachment of conductors. The base 12 further has a lead edge 18 which is of any desired thickness and which is insertable into a mating connector of a conventional type. The acceptable thickness is dictated by the mating connector.

Formed on the same surface 20 as forms the concave surface of the cavity 16, are lead edge contact pads which are ground pads 22 and signal pads 24. The contact pads are preferably gold plated over a copper layer. The underlying copper structure may be deposited in the desired pattern by any conventional plating technique and is not critical as long as the technique chosen will produce the metallurgical pattern desired with the desired dimensional control.

Extending from the lead edge contact pads 22, 24 are signal lines 26 and ground lines 28. The signal lines 26 and ground lines 28 may be of any suitable conductive material but in the preferred embodiment are typically copper, plated onto the base 12. The ground and signal lines 28, 26 extend from the lead edge contact pads 22, 24 to the interior of the cavity 16 of the base 12. The signal lines 26 preferably terminate in a signal pad 30 for attachment of signal conductor 36 of a wire or cable 4. The signal pad 30 is again any suitable conductive material and is preferably a lead/tin solder which may be deposited directly on the base 12 or may be deposited over an extension of the copper signal line 26. The lead/tin solder of the signal wire termination pad 30 is desirable since the signal wire 36 of the cable 34 will be soldered to the pad 30 and the precoating or tinning of the pad 30 will enhance solderability.

The ground lines 28 from the lead edge contact pads 22 extend to a ground buss 32 which lies across the width of the connector 10. All ground lines 28 terminate into the buss 32 thereby affording the maximum reliability for grounding efficiency.

As is seen in FIG. 1, the alternating pattern of ground lines 28 and signal lines 26 results in the isolation of each signal line between the two adjacent ground lines 28 and the ground buss 32. This arrangement provides some shielding of the signal lines 26 from spurious signals and interference as well as cross-talk between the adjacent signal lines 26.

The electrical signals to and from the connector 10 are carried by the cables 34. Cables 34 are preferably made up of three conductors, a signal conductor 36 and two helically wound ground conductors 38. The signal conductor 36 is terminated on the signal wire termination pad 30, by soldering. Similarly the ground conductors 38 are terminated on the ground buss 32 by soldering. Only one cable 34 is shown in the drawings for clarity, but it is understood that typically there are cables 34 for each signal wire termination pad 30.

Referring now to the cover 14, the interior forms a cavity 40 which is positioned over and encloses the pattern of ground lines 28, signal lines 26, signal wire termination pads 30 and ground buss 32. Within the cavity 40, there are formed a series of ribs 42 which may be made as a part of the cover 14 preferably by molding as the cover 14 is molded of thermoplastic material. The ribs 42 are of such a height from the interior of the cavity that the exposed edge 44 will contact and engage the ground line 28 over which the rib 42 is placed. The rib 42 is formed to have sufficient length that a portion of the exposed edge 44 will likewise contact the top surface of the ground buss 32.

The ribs 42 and the interior surface of cavity 40 are provided with an electrically conductive coating, preferably plated copper. The conductive coating over the cavity 40 surface and the ribs 42 will act in conjunction with ground lines 28, and ground buss 32 to form tunnels of grounded, electrical shielding substantially surrounding the signal lines 26 so that the effect is that of coaxial shielding of the signal lines 26. The only exposed area of a signal line 26 is that portion of the line 26 which is attached to the material of the base 12 during the plating process.

The path of crosstalk between the adjacent signal lines 26 is intercepted by a rib 42 with a conductive grounded coating. This greatly reduces the cross-talk present on the signal lines 26.

Should the complete enclosure of the signal line 26, within a shielded tunnel be essential, it can be easily accomplished. To do so, the surface of cavity 16 would be plated, preferably with copper, and an insulating layer deposited in those regions that would support the signal lines 26 and the signal wire termination pads 30. The signal lines 26 and termination pads 30 would then be deposited on the insulating material as described above. The lead edge ground contact pads 22 would then be formed as described earlier and in contact with the grounding shield layer covering the cavity 16. The deposit of the insulating material would effectively form the ground lines 28 and subsequently the lead/tin solder would be deposited on the grounding layer to form the contact zone of the ground buss 32.

Figure 2:
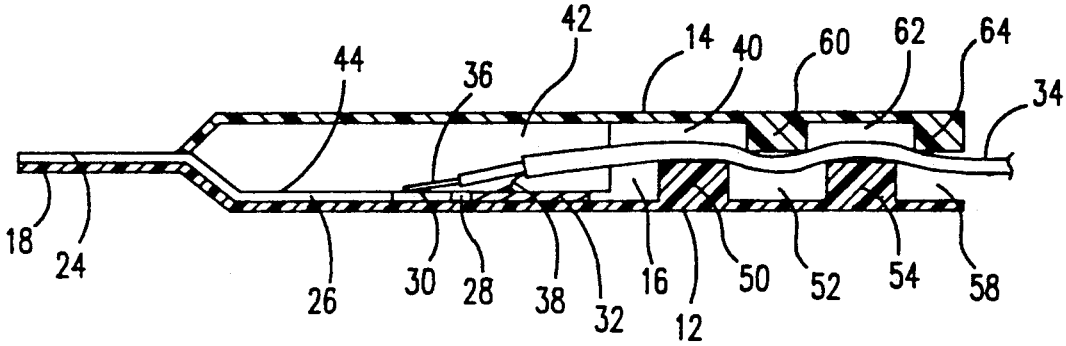
FIG. 2 is a sectional view of the base and cover of the connector with the strain relief structure illustrated.
Figure 3:
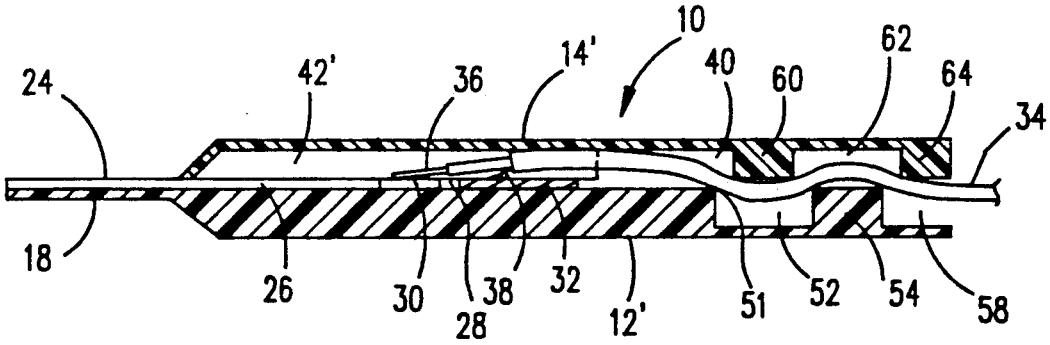
FIG. 3 is a sectional view of an alternate embodiment of the base and cover of the connector with the strain relief structure illustrated.

An alternative embodiment of the connector 10 is shown in section form in FIG. 3. The most significant difference in the connector 10' of FIG. 3 is that the surface upon which the signal lines 26, ground lines 28 and ground buss 32 are deposited is a planar extension of the surface of the lead edge 18 that holds and supports lead edge contact pad 24. Correspondingly, the ribs 42' of cover 14' are shortened to conform to and contact the ground lines 28 of the base 12' as described above with respect to ribs 42 and base 12. In FIG. 3, the reference numerals that are the same as in FIGS. 1 and 2 denote elements of the invention that are the same as or so closely analogous to the like-numbered elements in FIGS. 1 and 2 as to not need separate explanation. Elements denoted by a primed reference numeral are analogous to the same numbered element in FIGS. 1 and 2 but are changed to such a degree that explanation is made. Those of skill in the art will understand the embodiment of FIG. 3 without further explanation over and above that for FIGS. 1 and 2.

The shells 12, 14 of the connector 10 are formed preferably by injection molding a thermoplastic material of such strength and insulative qualities as to withstand handling and provide insulation to the metallurgical patterns within the structure. Many such materials are available in the market under designations such as ULTEM manufactured by General Electric Plastics, VICTREX PES manufactured by I.C.I. and UDEL manufactured by Amoco Corporation. For additional strength, it is preferred that a glass-filled thermoplastic resin be used to form the connector housing shells 12, 14. The glass fiber filling adds dimensional stability and control and also yields a much stronger part. Such glass filled materials that are suitable for use in this invention include ULTEM 2200 manufactured by General Electric Plastics, VICTREX PES 3601GL20 manufactured by I.C.I. and UDEL GF-120 manufactured by Amoco Corporation.

The shells 12, 14 of the connector 10 are provided with recesses and ribs 50, 54, 60 and 64 intermediate the recesses 52, 62 and 58 to form a path for the cables 34 to pass through on the way from the entrance cavity 58 to the ground buss 32 and the signal wire termination pads 30. Referring to FIG. 2, forming the rear wall of cavity 16 is a raised portion or rib 50. The rib 50 extends laterally across the width of the connector 10. Further rearward from the rib 50 is a cavity 52 formed by the rib 50 and a second rib 54 and closed in by the side walls 56 of the base shell 12. Ribs 50, 54 may have a width of any desired dimension.

Rib 54 forms the front wall of a open recess 58. Recess 58 is open to the rear of the base 12.

Referring now to cover 14, ribs 60, 64 analogous to the ribs 50, 54 are formed as a part of the molding process for the cover 14. The ribs 60, 64 are dimensioned in width such that they will allow an insulated wire or cable of a chosen size to pass between rib 60 and ribs 50 and 54, when the cover is assembled, with some engagement of the insulation of the cable 34 by both ribs 60 and rib 50 and 54. Accordingly, the cable 34 is trapped between the ribs 50, 54 of the base 12 and the ribs 60, 64 of the cover 14. The ribs 60, 64 of the cover 14, when assembled, overlie the cavity 52 and 56 respectively. With the wires 34 passing through cavities 56, 62, 52 and then into cavity 16, the wires 34 wind a serpentine path and are engaged by the corners of the ribs 64, 54, 60 and 50. This engagement of the insulation of the wires 34 acts as a strain relief to prevent the breaking of the bonds of the ground wires 38 from the ground buss 32 and the signal wire 36 from the signal wire termination pad 30.

The base 12 is provided with surfaces 70 of the walls 66. Similarly, the cover is provided with surfaces 72 of side walls 68. When the cover 14 is mated with base 12, surfaces 70 and 72 are in an abutting relation to each other and the two shells 12, 14 may be joined by any desired technique. The preferred technique is that of ultrasonic bonding where the two shells 12, 14 are vibrated against each other to the point that the thermoplastic material is softened or melted and then allowed to cool and fuse in the region of the cover 14/base 12 interface. When bonded, the result is a permanent joining of the shells 12, 14 to form the housing of the connector 10.

The advantages of an air-filled dielectric are afforded by the serpentine path and wire insulation engagement by the base 12 and cover 14. The need to inject a material into the housing to act as a strain relief is thus eliminated.

While there have been shown and described preferred and alternative embodiments, other changes may be apparent to those of skill in the art and such changes and modifications may be made without departing from the scope of the invention as defined in the appended claims.

We claim:

1. An electrical connector comprising: a shell structure formed of mating first and second shell members;

said first shell member having an interior surface and an exterior surface;

an edge connector portion protruding from said first shell member;

said first shell member comprising walls and ribs forming at least a partial enclosure of a plurality of said cavities;

a first plurality of electrical contact pads positioned on said edge connector portion, on the same surface as said interior surface portion, and spaced along said edge connector portion;

a second plurality of electrical contact pads on said edge connector portion and positioned alternately with said first plurality of electrical contact pads;

a first plurality of conductive paths electrically connected to said first plurality of electrical contact pads and extending from said first plurality of electrical contact pads to within said first shell portion;

a ground buss formed on said interior surface of said first shell portion;

said second plurality of electrical contact pads interconnected to said ground buss by a second plurality of conductive paths;

said second shell member comprising a cavity and an exterior surface;

said second shell member cavity lined with an electrically conductive coating and means which interconnect said coating with said ground buss;

whereby said shell portion and said second plurality of electrical contacts interconnected with said ground buss contain and shield said plurality of conductive paths connected to said first plurality of electrical contact pads.

2. The connector of claim 1 wherein said first and second shell members each comprise mating surfaces for bonding whereby said shell members may be permanently joined.

3. The connector of claim 2 wherein said mating, surfaces are vibratorally heated and fused together.

4. The connector of claim 1 where in said first and second shell members comprise alternate raised and cavity portions which comprise a strain relief holding means for engaging insulated electrical conductors.

5. The connector of claim 1 wherein said connector further comprises a plurality of attaching regions, each electrically connected to one of said first plurality of said conductive paths, thereby providing a region to which an electrical conductor may be attached for each of said first plurality of said conductive paths.

6. The connector of claim 1 wherein said means connecting said coating and said ground buss comprises a plurality of raised elongated portions supported by said surface of said cavity.

7. The connector of claim 6 wherein said raised elongated portions support thereon an electrically conductive coating electrically connected to said electrically conductive coating of said second shell member.

8. The connector of claim 7 wherein said elongated portions lie parallel to said second plurality of conductive paths between said second plurality of said contact pads and said ground buss.

9. The connector of claim 8 wherein said electrically conductive coating on said elongated portions contacts said second plurality of conductive paths connected to said ground buss.

10. An electrical connector comprising:

two thermoplastic mating shell members forming a cavity, one of said shell members supporting signal contacts and ground contacts exterior to said cavity for insertion into a mating connector;

said contacts connected to signal lines and ground lines extending to within said connector:

said ground lines interconnected to a common means for grounding;

said second shell member comprising rib members parallel to said lines;

said rib members and said second shell member supporting an electrically conductive coating, said coating in contact with said ground lines;

whereby when said rib members and said coating are in contact with said ground lines, said ground lines and said coating form hollow passages enclosing each of said signal lines on at least three sides thereof, thereby providing shielding to said signal lines.

11. The connector of claim 10 wherein said ground lines are formed as a continuous coating of conductive material with discrete regions of insulation material deposited thereon, and said signal lines are formed onto said insulation material, thereby forming ground lines as narrow exposed regions of said conductive material intermediate said signal lines.

12. The connector of claim 10 wherein said shell portions are joined together.

13. The connector of claim 12 wherein said shell portions are joined with a thermal bond.

14. The connector of claim 13 wherein said ground lines of said connector are connected to ground conductors and said signal lines are connected to signal conductors of wires or cables.

15. The connector of claim 14 wherein said cables are discrete cables having a single signal conductor and at least one ground conductor wrapped about said signal conductor.

16. The connector of claim 14 wherein said cables are joined to form a flat ribbon cable.

17. The connector of claim 15 wherein said shell members comprise mating raised and recessed portions forming a tortuous path for said cables whereby said cables are held by said connector to prevent pulling said conductors from said signal and ground contacts.

* * * * *